United States Patent [19]

Lauener

[11] Patent Number: 4,964,456

[45] Date of Patent: Oct. 23, 1990

[54] CONTINUOUS CASTING PROCESS AND MACHINE WITH AT LEAST ONE TRAVELLING CASTING BELT FOR THE PRODUCTION OF METAL STRIPS AND RODS

[75] Inventor: Wilhelm F. Lauener, Gerlafingen, Fed. Rep. of Germany

[73] Assignee: Larex AG, Recherswil, Switzerland

[21] Appl. No.: 293,064

[22] Filed: Jan. 3, 1989

[30] Foreign Application Priority Data

Jan. 28, 1988 [CH] Switzerland ..... 0297/88

[51] Int. Cl.[5] ..... B22D 11/06

[52] U.S. Cl. ..... 164/481; 164/432; 164/435

[58] Field of Search ..... 164/427, 429, 430, 431, 164/432, 433, 435, 479, 481, 482

[56] References Cited

U.S. PATENT DOCUMENTS

| | | | |
|---|---|---|---|
| 3,326,271 | 6/1967 | Cofer | 164/433 |
| 3,702,629 | 11/1972 | Leroy | 164/479 |
| 3,749,150 | 7/1973 | Properzi | 164/433 |
| 4,172,490 | 10/1979 | Ware | 164/433 |
| 4,579,169 | 4/1986 | Bradley et al. | 164/481 |
| 4,644,999 | 2/1987 | Bedell et al. | 164/479 |
| 4,735,254 | 4/1988 | Itoyama et al. | 164/481 |

FOREIGN PATENT DOCUMENTS

| | | |
|---|---|---|
| 55-10394 | 1/1980 | Japan . |
| 61-159249 | 7/1986 | Japan . |
| 266161 | 11/1986 | Japan . |
| 61-266161 | 11/1986 | Japan . |
| 279345 | 12/1986 | Japan . |
| 61-279345 | 12/1986 | Japan . |

*Primary Examiner*—Richard K. Seidel

*Attorney, Agent, or Firm*—Marks Murase & White

[57] ABSTRACT

Casting process and device for the continuous casting of strip and thin slabs or rods whereby at least one wall of a casting mold is formed by a flexible open-end casting belt which travels from a coil through the mold is coiled up again after passing through the mold. The belt is submitted to a tensile force acting in the direction of its path of motion and so intensely that the belt, when it is heated up in the mold, is stressed beyond its elastic limit as to cause the belt to be strained to the extent that the growth of its cross-sectional area resulting from thermal expansion is sufficiently compensated for by the reduction of its cross-section due to the strain in the belt. Thereby an inadmissable deformation of the belt due to its thermal expansion is prevented.

16 Claims, 2 Drawing Sheets

Figure 1:
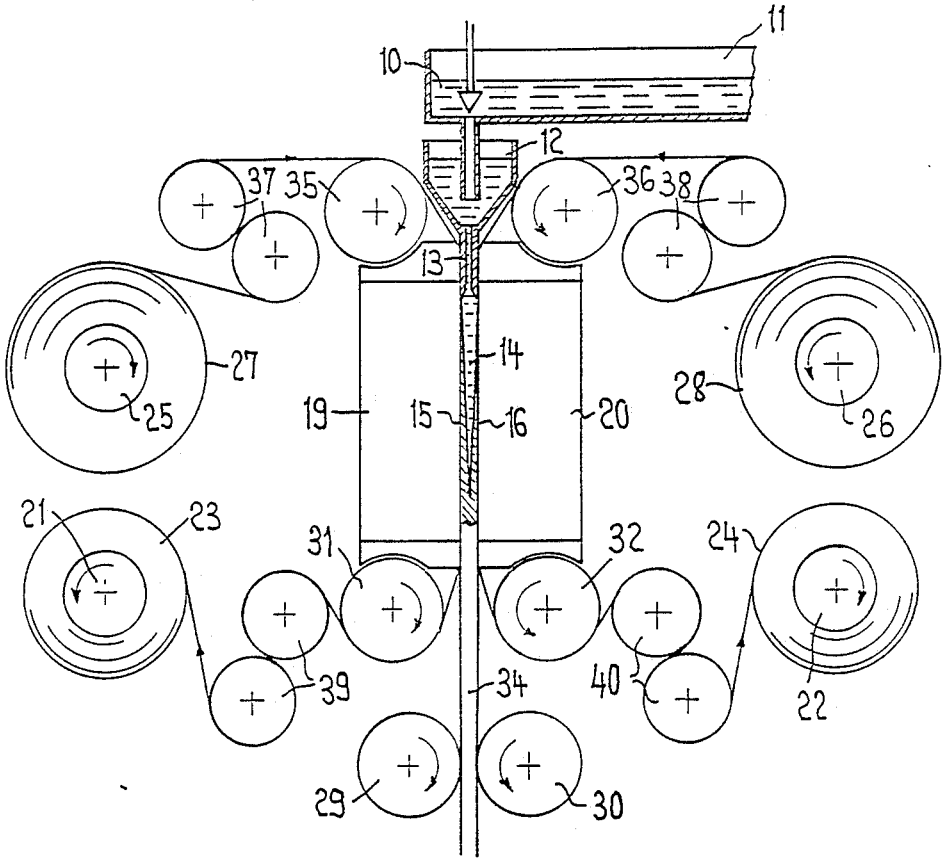

CONTINUOUS CASTING PROCESS AND MACHINE WITH AT LEAST ONE TRAVELLING CASTING BELT FOR THE PRODUCTION OF METAL STRIPS AND RODS

Various processes and devices are known for the continuous casting of strip and thin slabs or rods of ferrous and nonferrous materials by which at least one wall of the casting chamber or so called mold consists of a flexible metallic belt that travels along with the casting until the latter is completely solidified or a frozen shell of suffficient strength has been formed, as is the case in processing steel. Reference is especially made to twin-belt casting machines where liquid metal is fed in between a pair of opposing circulating flexible metal belts which confine the metal between them as it solidifies. While moving along the casting region, the belts are generally cooled by water on the outside surface to remove the heat liberated from the casting.

Characteristics and general design of production facilities of different kinds with travelling belts are shown in the "Handbook of Continuous casting" by E. Herrmann, 1980, p. 65 to 85.

Known casting machines have used belts having a thickness ranging from 0.5 to 1.5 mm or more. In general these belts consist of steel, but other materials have also been proposed.

Although casting facilities with traveling belts have been known for decades and corresponding casting methods appear economically attractive, they are not yet found in general use mainly due to problems caused by the belts, as hereinafter set forth.

It is common practice to use so called side dams which travel with the belts to seal off the mold laterally. Stationary side dams are also in use. Therefore the width of the belts is considerably larger than the mold so that a side dam may be arranged in between the edge portions of the belts on both sides in order to provide the required tightness of the mold.

Despite an application of intensive cooling while moving along the casting region, a considerable rise in temperature occurs in a belt when its surface comes into contact with the metal being cast. A particularly critical condition exists at the entrance of the mold, where an extremely abrupt heating of the belt takes place upon its first contact with the molten metal eminating from the casting nozzle. At this place the belt normally reaches its highest temperature (reference is made to the publication in "Stahl und Eisen", No. 11, 1986, p. 635, FIG. 8).

The heated portion of the belt is inherently subject to thermal expansion in all three dimensions. There is no objection to the growth of a belt's thickness, but its cold edge portions and its yet cold cross-section which is about to meet the liquid metal, prevent a free expansion of the belt within its plane. The natural reaction of the belt is warping and buckling, beginning at the entrance and extending over a large part of the mold.

Obviously a local and temporal function of the heat transfer from the casting to the belt occurs whenever the belt detaches from or contacts the surface of the casting. The phenomenon is often the source of differences in the thickness of the cast product and of detrimental heat sinks causing cracks and local structural defects. The warpage of a belt also impedes the sealing of the mold at the side dam and at the casting nozzle. These problems often cause rejects of cast material and are the reason for severe troubles with the casting process. The difficulties grow considerably with an increase of the width of the casting.

Great difficulties arise particularly with the casting of steel. Up to this time attempts were made to solve the problems described by relatively high tensioning of the belts and/or by applying a thermally insulating layer on the surface of the belt contacting the casting (see such a solution for example in U.S. Pat. No. 3,871,905) and/or by preheating the belts before their entering into the casting region (U.S. Pat. Nos. 3,937,220, 4,002,197 and 4,537,243). Even though these prior attempts may have helped to decrease the deformation due to thermal stresses in the belt, they have not sufficed to completely avoid warping and distortion in the casting region.

In these prior continuous casting machines, in order to avoid an unacceptable lengthening during operation, only a moderate tension of the belt is acceptable, so that the arising stresses are kept within the elastic limit as the circulating belt is bent around the pulleys ahead and after the mold region Repeated stresses exceeding the elastic limit obviously causes the lengthening the belt, rendering it useless after a short period of time.

The aim of the present invention is to eliminate the existing problems, to prevent warping and buckling of the belt in the mold and to eliminate the hitherto existing disadvantages of the casting process.

According to the laws governing the strength of materials, a body submitted to a tensile stress is subject to an elongation accompanied by a transversal contraction. This behaviour appears in the elastic as well as in the ductile phase of a deformation. Both influences act in the same direction and superimpose cumulatively.

It is also known that with increasing temperature the elastic limit of the belt's material decreases.

The present invention is directed to a solution to the before explained problems with casting belts is based on the application of these physical phenomena and is characterized by the use of open-end belts of arbitrary length, whereby a belt is submitted to a stretching force acting in the direction of its path of motion, causing a tension which exceeds the belt's elastic limit when the belt heats up in the mold, whereby the belt is strained to the extent that a contraction of its cross-sectional area takes place to counteract its thermal expansion, thereby preventing warping and/or buckling of the belt while it is moving along the casting region.

In view of the fact that relatively small thermal stresses may still be present in a belt without causing a warping thereof, the provoked decrease of the cross-section may be somewhat smaller than its increase due to thermal expansion.

With an adequately designed cooling system for the belt it is possible to maintain the temperature of the belt during its travel through the mold area within acceptable limits. It is also possible with a highly efficient cooling system to use naked, i.e. uncoated belts. However, if necessary, a belt can be coated in a known way by a separating and/or insulating agent before entering the casting region. The coating can be either permanent or so as to decompose within the mold.

An appropriately controlled brake acting on the belt at the entrance and an adequately designed belt drive at the exit side of the mold may be installed to submit the belt to the necessary stretching force in order to achieve the required degree of stress within the mold.

As a consequence of the straining of the belt within the mold there results a further characteristic of the process by the fact that the speed of the belt after leaving the casting region and after having cooled off will be accordingly higher than at the entrance of the mold.

It proves to be advantageous to adjust and maintain the belt's speed before the entrance and after the exit of the mold in a certain ratio rather than to control the belt tension. This can be done in various ways. Hereby, a constant, determined and controlled stretching of the belt can be achieved. Belt tension and strain thereby adjust to the existing ratio of the belt's speed before the entrance and after the exit of the mold.

The increase in speed due to the elongation of the belt thereby depends on the existing belt temperature, the possibly existant stress profile across its width before entering the mold and the admissible thermal stresses within the belt. The latter thereby depend on the ratio between the width of the belt and of the mold, the existing belt thickness, the physical characteristics of the belt material, on how the belt is supported and on the metallostatic pressure in the mold.

The respective values determine the required increase in belt speed between the entrance and the exit of the mold. Depending on the given conditions, the minimal increase in speed is found to be between 0.1 and 2%, with reference to the cooled off belt after its exit from the casting region, if warping of the belt is to be avoided.

The drive of the caster can be designed for a determined and fixed ratio of the belt's speed at the entrance and at the exit of the mold, or the speeds can be controlled analogically or digitally, by a computer for instance, so that the ratio may be adjusted whenever different conditions arise. The belt's speed is then measured continuously before and after the mold and processed by a controller in order to maintain the speed-ratio at the required value.

An open-end belt obviously must be long enough to allow an uninterrupted operation at a determined casting speed during a sufficient time. Therefore the belt will advantageously be drawn from a coil and will be coiled up again after its travel through the caster, having served as a wall of the mold in the described manner.

Hence, a continuous casting machine with one or more travelling casting belts for the production of metal strips or rods is characterized by the fact that open-end coiled belts of any chosen length are used, whereby each belt winds off a coil before entering the mold and is recoiled after travelling through the mold, whereby stretching means are provided for, by which a belt is submitted to a stretching force acting in the direction of its path of motion, causing a tension which exceeds the belt's elastic limit when the belt heats up in the mold, whereby the belt is strained to the extent that a contraction of its cross-sectional area takes place to counteract its thermal expansion, thereby preventing warping and/or buckling of the belt while it is moving along the casting region.

Figure 2:
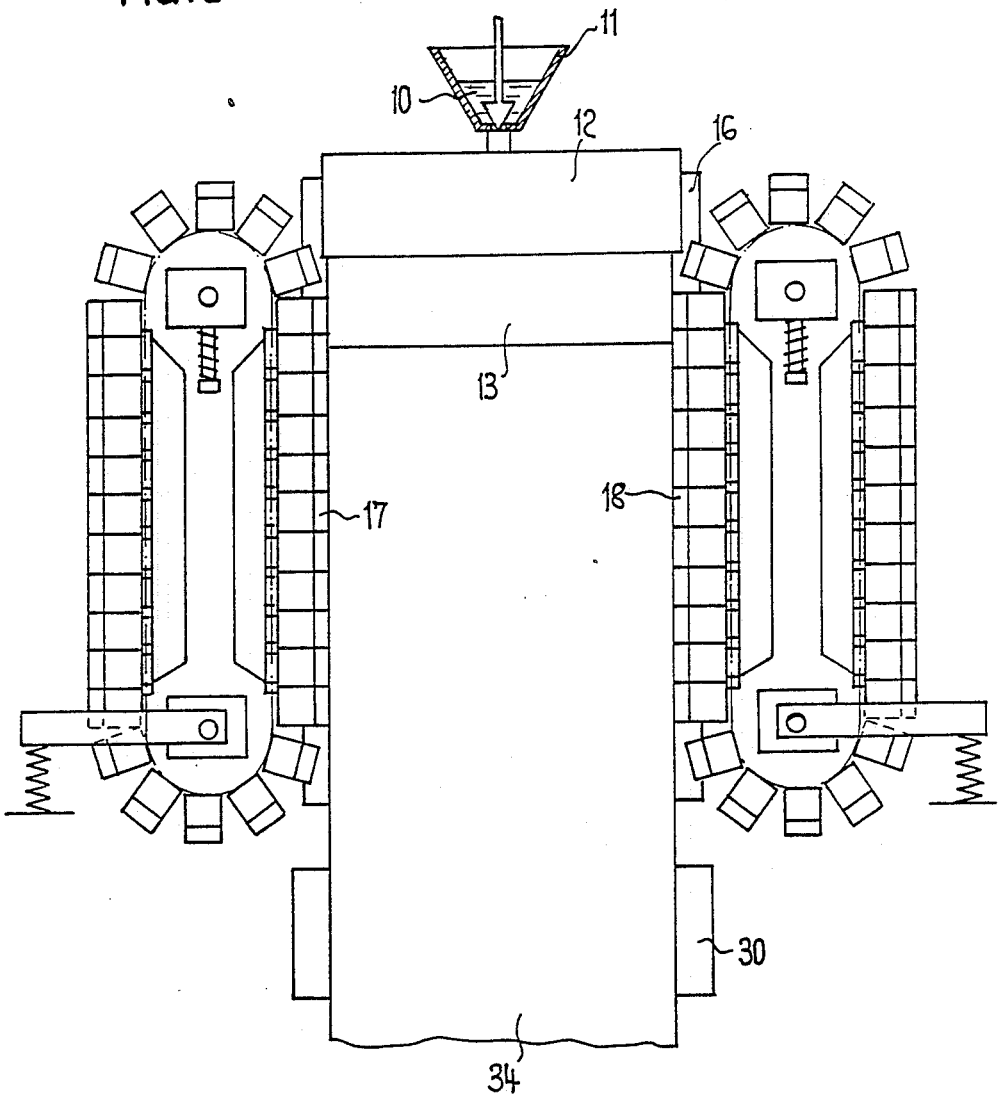

The invention will now be explained by means of a realized example with two belts, which is shown by FIG. 1 and 2 representing a schematic side view of a casting machine characterized by symmetrically opposed belts in a vertical casting arrangement. Travelling or stationary side dams may be used.

The molten metal 10 flows from the furnace to the tundish 12 in a known way by means of a launder 11 and is fed through the nozzle 13 into the mold 14, which is formed by the facing belts 15, 16 and the side dams 17, 18 (FIG. 2) arranged inbetween. The schematically indicated coolers 19, 20 are effective on the outside surface of the belts. The two coiler shafts 21, 22 with the coils 23, 24 are driven by a controllable drive while simultaneously the two down coilers 25, 26 with the coils 27, 28 are retarded by appropriately controlled brakes, so as to submit the belts 15, 16 to the necessary stretching force, in order to achieve the required degree of strain within the mold. The cast rod, or as shown in the example, the cast strip 34 is pinched by the two speed controlled rolls 29, 30 and moved out of the mold at casting speed.

The casting speed, which approximately corresponds to the belt speed, can be adjusted to the requirements and may be controlled by the drive of the coiler shafts 21, 22 in such a way, that a determined force acts within the belt, to bring about the required straining effect. Control signals are sent to the drive of the coilers 21, 22 for the continuous control of the belt speed after the exit of the mold and to the drive of the coilers 25, 26 for the control of the belt speed before the entrance of the mold, whereby the difference in speed between entrance and exit of the mold is so adjusted as to achieve the required degree of strain in the belt.

In order to relieve the coiler shafts 21, 22 of great forces, the rolls 31, 32 arranged after the exit of the mold, can also be driven and/or other rolls 39, 40 shown in FIG. 1 can be placed between the coiler shaft 21 and roll 31 resp. shaft 22 and roll 32. The belt can be partially wound around these rolls and/or they can pinch the belt, they can be driven or just free-wheeling, if the belt's path of motion is only to be changed to another direction. Equally, the rolls 35, 36, arranged before the casting mold can be braked and/or the coiler shafts 25, 26 can be relieved by additional rolls 37, 38, which can be braked. Furthermore the coiler shafts 25 and 26 can be relieved by belt brakes of arbitrary design.

Arrangement, number and diameter of additional rolls marked 37, 38 and 39, 40 in FIG. 1 depend on the required tension of the belt, on the choice with regard to the belt drive, on the casting direction or other circumstances and may be adjusted to the given conditions. The same or additional rolls and or other elements through or over which the belt glides may be used to reduce residual stresses in the belt. It is also possible to treat the belt outside of the casting machine in a known manner in order to remove existing residual stresses.

After the full length of the belt has been used, the coils 23 and 24 are removed and placed on the coiler shafts 25 and 26 respectively. The caster is ready for operation again after the belts 15 and 16 are guided through the machine and fastened to the coiler shafts 21 and 22 respectively.

An alternative to changing the coils exists in reversing the direction of rotation of the coiler shafts 21, 22, 25 and 26 in order to rewind the belts onto the coiler shafts 25 and 26 respectively.

Basically the object of the invention of causing strain in the belt as it is heated in the mold can be applied in a vertical or horizontal or in any other casting direction.

The measures encompassed by the invention are also applicable to processes and machines applying only one belt. The molten metal can for example be cast in a known way onto the surface of a horizontally moving belt in such quantity as to produce the required thickness of the cast strip.

Generally a belt, while passing the casting region, must be supported on its back side in order to avoid an unacceptable sagging due to the metallostatic pressure or the weight of the casting. However, the back side of the belt must be in continuous contact with flowing coolant, in order to prevent unacceptable, localized heating. It is known practice to put the distance between neighboring points of support in relation to the thickness of the belt. In existing facilities this distance ranges from 30 to 50 times the thickness of the belt. If the principals of the invention are applied, the relative distance can be substantially greater due to the considerably higher belt tension and can range from 100 to 250 times the thickness of the belt, depending on the load to be supported by the belt. It is thus possible that belts with a thickness of 0.1 to 0.3 mm can be used with the same distance between supporting points as in existing facilities, without inadmissible sagging of the belt.

Due to the occurring strain, the cross-section of a belt will be smaller with every pass through the mold. The respective reduction of the belt's width thereby determines the number of passes before the belt is worn out.

The following calculation illustrates an example for an aluminum strip produced in a casting machine with two steel belts and the data as listed:

| | | | |
|---|---|---|---|
| thickness of the aluminum strip | a | = | 20 mm |
| as cast width of the strip | b | = | 1000 mm |
| casting speed | v | = | 6 m/min |
| maximum width of a new casting belt | $B_1$ | = | 1200 mm |
| minimal acceptable width of a used casting belt | $B_2$ | = | 1080 mm |
| thickness of a casting belt | c | = | 0.2 mm |
| temperature of the belts before entering the hold | $T_1$ | = | 40° C. |
| max. temperature of the belts in the mold | $T_2$ | = | 160° C. |
| rise in temperature | $\Delta T$ | = | 120° C. |
| linear thermal coefficient of expansion | $\alpha$ | = | $11 \cdot 10^{-6}$ (°C.)$^{-1}$ |
| max. outside diameter of the full coil | D | = | 1500 mm |
| diameter of the coiler shafts | d | = | 400 mm |

For the following considerations further denotations are given:

| | |
|---|---|
| v | casting speed |
| $v_1$ | speed of the belt prior to entering the mold |
| $v_2$ | speed of the belt after being heated in the mold |
| $A_1$ | cross-section of the belt prior to entering the mold |
| $A_2$ | cross-section of the belt after being heated in the mold |
| $V_1$ | volume of a belt particle before entering the mold |
| $V_2$ | volume of a belt particle after being heated in the mold |
| $\Delta V$ | growth of a belt particle due to its being heated in the mold |
| $\Delta B$ | reduction of the belt's width due to a pass throught the mold |

Assuming that the temperature of the belt is raised by $\Delta T$ in the casting chamber, the increase in volume of a belt particle approximately amounts to:

$$\Delta V = 3 \cdot \alpha \cdot \Delta T \cdot V_1$$

If an increase in cross-sectional area is to be avoided, i.e. $A_2 = A_1$ in order to prevent belt distortion, then the continuity equation reads as follows:

$$v_1 \cdot V_2 = v_2 \cdot V_1$$

hence $$v_2 = v_1 \cdot \frac{V_2}{V_1} = v_1 \cdot \frac{V_1 \cdot (1 + 3 \cdot \alpha \cdot \Delta T)}{V_1} = v_1 \cdot (1 + 3 \cdot \alpha \cdot \Delta T)$$

and with the given values of the examples:

$$v_2 = v_1 \cdot (1 + 3 \cdot 11 \cdot 10^{-6} \cdot 120) = 1.0040 \cdot v_1$$

This means that the speed of the belt must grow by 0.40% in order to prevent an increase of its cross-sectional area while being heated. Virtually, however, an increase in belt speed of 0.38% is sufficient in the case presented, because the belt can bear small thermal stresses without detrimental distortion or buckling.

As mentioned above, the belt's width is reduced with every pass through the mold due to the transversal contraction. In the example under discussion, the reduction per pass approximately amounts to:

$$\Delta B = \Delta T \cdot \alpha \cdot B \cdot \frac{0.38}{0.40} = 120 \cdot 11 \cdot 10^{-6} \cdot 1200 \cdot 0.95 = 1.5 \text{ mm}$$

Given a maximal and a minimal belt width of $B_1 = 1200$ mm and $B_2 = 1080$ mm respectively, the belt can be used $$n = \frac{1200 - 1080}{1.5} = 80 \text{ times}$$

The belt's thickness thereby decreases by approx. 10% down to 0.18 mm.

Given a casting speed of $v = 6$ m/min and a diameter of $D = 1500$ mm for a full coil, corresponding to a storage of 8200 m of belt length, the facility can be operated continuously for 22.8 hours. Thus, full capacity operation yields a production of 440 tons per day.

What I claim:

1. A process for the continuous casting of metal strips or rods comprising:

unwinding a dispensing means containing an open ended travelling casting belt having a cross-section and an elasticity;

feeding said belt into a casting region;

forming a mold for producing metal strips or rods with said belt in said casting region;

passing said belt out of said casting region; and recoiling said belt onto a take-up means, whereby said belt is irreversibly stretched by a tension greater than the elasticity of said belt, the tension caused by the interaction of said dispensing means and said take-up means, the tension being in a direction along said belt's path of motion, so that a contraction of said belt's cross-section occurs, thereby preventing warping or buckling of said belt while it moves along the casting region.

2. The process according to claim 1, wherein said belt has a first speed when entering the casting region and a second speed when exiting said casting region.

3. The process according to claim 2 wherein the speed of said belt exiting the casting region is greater than the speed of said belt in entering the casting region.

4. The process according to claim 3 wherein the speed of said belt exiting the casting region is 0.1 to 2 percent greater than the speed of said belt entering the casting region.

5. The process according to claim 4, further comprising measuring said first speed and said second speed of said belt.

6. The process according to claim 5 wherein the ratio of said second speed of said belt to said first speed of said belt is maintained at a set value.

7. An apparatus for the continuous casting of metal strips or rods comprising:

at least one open ended travelling casting belt having a cross-section and an elasticity;

a dispensing means containing said belt, said dispensing means adapted to unwind said belt into a casting region having an entrance and an exit;

a take-up means onto which said belt is recoiled after having passed through said casting region; and stretching means for irreversibly stretching said belt in the direction of its path of motion and contracting the cross-sectional area of said belt by applying a tension to said belt greater than its elasticity, thus preventing warping and buckling of said belt while it is moving through said casting region.

8. The apparatus according to claim 7 wherein said belt has a thickness of from about 0.1 mm to about 0.3 mm.

9. The apparatus according to claims 7 or 8, wherein said belt, when in the casting region, is prevented from sagging by supports.

10. The apparatus according to claim 9, wherein said supports are located at distances from one another of about 100 to 250 times the thickness of said belt.

11. The apparatus according to claim 7, further comprising at least one roll positioned at the exit of the casting region, said at least one roll being in force-transmitting relation with said belt, and being able to impart forces to the belt.

12. The apparatus according to claim 7, further comprising at least one roll positioned before the entrance to the casting region, said at least one roll being in force-transmitting relation with said belt, and being able to impart forces to the belt.

13. The apparatus according to claim 7, further comprising a belt brake, said belt brake being located prior to the entrance of the casting region.

14. The apparatus according to claim 7, further comprising guiding elements over which and through which said belt glides, said guiding elements being stationary or rotating with a peripheral speed lower than the speed of said belt.

15. The apparatus according to claim 7, further comprising means for stretching said belt after said belt leaves the casting region to reduce or eliminate any residual stresses in said belt.

16. A process for the continuous casting of metal strips or rods comprising:

unwinding an open ended travelling casting belt having a cross-section from a dispensing means;

feeding said belt into a casting region at a first speed;

forming a mold with said belt for producing metal strips or rods in said casting region;

passing said belt from said casting region at a second speed, said second speed exceeding said first speed, thereby irreversibly stretching said belt in a direction along its path of motion so that a contraction of its cross-section occurs, thereby preventing warping or buckling of said belt as it moves along the casting region; and recoiling the casting belt after the belt has passed through the casting region.

* * * * *

UNITED STATES PATENT AND TRADEMARK OFFICE

CERTIFICATE OF CORRECTION

PATENT NO. : 4,964,456

DATED : October 23, 1990

INVENTOR(S) : Wilhelm F. LAUENER

It is certified that error appears in the above—identified patent and that said Letters Patent is hereby corrected as shown below:

On the title page:

Item [75], ". . . Gerlafingen, Fed. Rep. of Germany" should be -- . . . Gerlafingen, Switzerland --.

Signed and Sealed this

Twenty-first Day of April, 1992

*Attest:*

HARRY F. MANBECK, JR.

*Attesting Officer*

*Commissioner of Patents and Trademarks*